US007955157B1

(12) United States Patent
Hedeen, Jr.

(10) Patent No.: US 7,955,157 B1
(45) Date of Patent: Jun. 7, 2011

(54) BATON APPARATUS

(75) Inventor: Clemens V. Hedeen, Jr., Sturgeon Bay, WI (US)

(73) Assignee: Hedeen International, LLC, Sturgeon Bay, WI (US)

( * ) Notice: Subject to any disclaimer, the term of this patent is extended or adjusted under 35 U.S.C. 154(b) by 0 days.

(21) Appl. No.: 12/730,852

(22) Filed: Mar. 24, 2010

(51) Int. Cl.
*A63H 33/00* (2006.01)

(52) U.S. Cl. ..... 446/236; 446/242; 446/266

(58) Field of Classification Search ..... 446/236, 446/242, 246, 266; 84/477 B
See application file for complete search history.

(56) References Cited

U.S. PATENT DOCUMENTS

| | | | | | |
|---|---|---|---|---|---|
| 2,226,949 | A | | 12/1940 | Simpson | |
| 2,601,554 | A | * | 6/1952 | Peters | 362/102 |
| 2,681,979 | A | * | 6/1954 | Manoloff | 362/102 |
| 2,812,683 | A | * | 11/1957 | Harrold et al. | 84/477 B |
| 2,882,779 | A | * | 4/1959 | Hooker | 84/477 B |
| 2,918,839 | A | | 12/1959 | Kaplan | |
| 2,988,949 | A | * | 6/1961 | Rohmann | 84/477 B |
| 3,008,264 | A | | 11/1961 | Rutherford | |
| 3,069,804 | A | * | 12/1962 | Cirafesi | 446/266 |
| 3,083,018 | A | * | 3/1963 | Kauffman et al. | 273/412 |
| 3,120,147 | A | * | 2/1964 | Fietcher | 84/477 B |
| 3,636,811 | A | * | 1/1972 | Bailey | 84/477 B |
| 3,810,411 | A | * | 5/1974 | Schambacher | 84/477 B |
| 3,962,949 | A | * | 6/1976 | Trowbridge et al. | 84/477 B |
| 4,119,310 | A | * | 10/1978 | Trubody | 472/23 |
| 4,964,636 | A | | 10/1990 | Ashihara | |
| 5,024,434 | A | * | 6/1991 | Smith | 482/107 |
| 6,213,623 | B1 | * | 4/2001 | Campman | 362/202 |
| 6,675,918 | B2 | * | 1/2004 | Chou | 175/394 |
| 7,238,147 | B2 | * | 7/2007 | Mills et al. | 482/106 |

* cited by examiner

*Primary Examiner* — Gene Kim
*Assistant Examiner* — Alyssa M Hylinski
(74) *Attorney, Agent, or Firm* — Gifford, Krass, Sprinkle, Anderson & Citkowski, P.C.

(57) ABSTRACT

An embodiment of a baton apparatus may include a grip having an inner ring and an outer ring. The inner ring may have a handle. The outer ring may be mounted concentric to the inner ring and be movable/slidable with respect to the inner ring. A ratchet assembly that is positioned on the grip may also be provided for driving the outer ring in a predetermined direction. In addition, at least two arms may be provided that are mounted to, and extend radially outward from, the outer ring. In operation, the ratchet may function to permit the outer ring to remain substantially stationary as the inner ring is rotated in a first direction, and then function to permit the inner ring to drive the outer ring as the inner ring is rotated in a second opposite direction.

20 Claims, 3 Drawing Sheets

BATON APPARATUS

FIELD OF THE INVENTION

A baton apparatus is disclosed that may include a grip and a number of arms mounted to the grip. The apparatus may be configured so that the arms revolve around the grip giving the apparatus the appearance of a twirling baton. A ratchet assembly may also be provided that allows a user to transmit to the arms a force sufficient to cause the arms to revolve around the grip.

REFERENCE TO RELATED ART

Baton twirling can be a fun and enjoyable activity. However, it is not an easy skill to learn, and can take years to master. To help overcome this learning curve, the 1950s and 60s witnessed a number of advances in baton design. One of those advances included the concept of mounting a traditional baton so that it may freely rotate about a handle.

One example of a "free rotation" baton is U.S. Pat. No. 2,812,683 to Harrold et al. This reference disclosed a baton that was mounted to, and free to rotate around, a handle located at a midpoint of the baton. In another embodiment (FIG. 6), Harrold et al. disclosed a baton having a pair of coaxial baton sections that extended from a ball race assembly positioned proximate the midpoint of the apparatus. However, as mentioned supra, Harrold et al and references like it all taught the use of a baton that was free to rotate around a handle. As a result, the baton was free to rotate in either a clockwise or counterclockwise direction and the user was required to physically push the baton to initiate the rotation.

SUMMARY OF THE INVENTION

A baton apparatus may include a grip and arms that may be mounted to, and uniformly spaced around, the grip. The grip may include two ring members. A first or inner ring may include a handhold that may be grasped by a user (not shown). A second or outer ring may be rotatably mounted concentric to the inner ring so that the outer ring may rotate or revolve (i.e., "spin") around the inner ring. As mentioned, the arms may be fixed to, or optionally, removably mounted to the outer ring.

A ratchet assembly may also be provided and configured so that the outer ring may only rotate in a predetermined direction. The ratchet assembly may also operate to allow a user grasping the handhold to impart a force to the outer ring sufficient to cause the outer ring—and thus the arms—to revolve around the grip. The apparatus may be formed or otherwise constructed, in whole or in combination, from a plastic, a metal, or other materials well known in the art.

In operation, a user may grasp and turn the handhold of the inner ring in a predetermined direction (clockwise or counterclockwise). As the user turns the inner ring 16, the outer ring 18 may "slip" relative to the inner ring 16 and/or otherwise remain relatively stationary with respect to the inner ring 16. Then, following this "wind-up" motion, the user may initiate a rotation of the outer ring 18 by rotating the inner ring 16 in the opposite direction. This rotation of the inner ring 16 in the opposite direction causes the ratchet assembly 22 to engage, drive and rotate the outer ring 18 (and also the arms 14 mounted to the outer ring 18).

BRIEF DESCRIPTION OF THE DRAWINGS

Reference will be made infra to the attached drawings wherein like reference numerals refer to like parts throughout, and wherein.

DETAILED DESCRIPTION OF THE INVENTION

Figure 1:
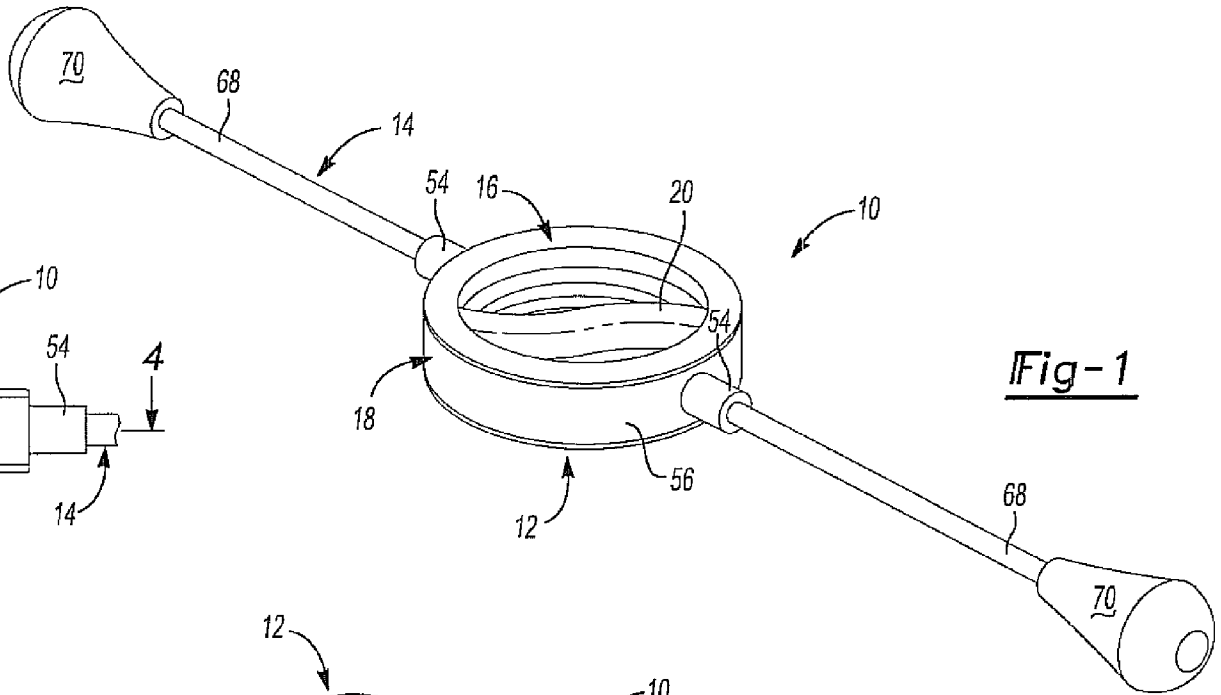
FIG. 1 is a perspective view of an embodiment of a baton apparatus.
Figure 2:
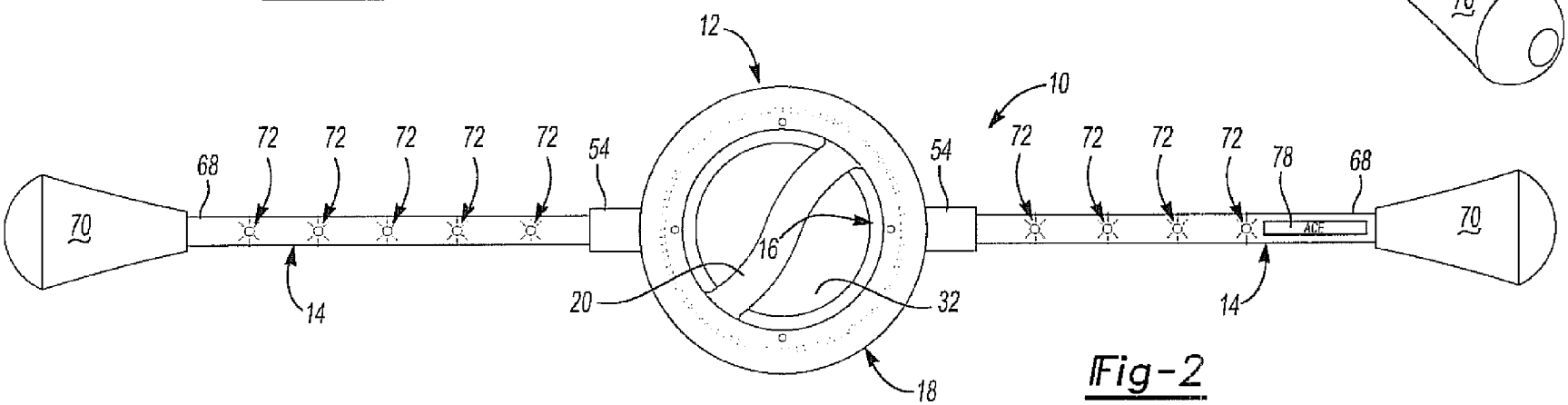
FIG. 2 is a planar side view of the embodiment of the baton apparatus shown in FIG. 1.
Figure 3:
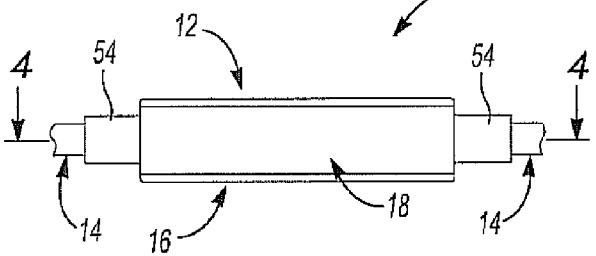
FIG. 3 is a planar edge or "top" view of the grip of the baton apparatus shown in FIG. 1.

Referring now to FIGS. 1-7, a baton apparatus 10 may include a grip 12 and arms 14 that may be mounted to, and uniformly spaced around, the grip 12. The grip 12 may include two ring members 16, 18. A first or inner ring 16 may include a handhold 20 that may be grasped by a user (not shown). A second or outer ring 18 may be rotatably mounted concentric to the inner ring 16 so that the outer ring 18 may rotate or revolve (i.e., "spin") around the inner ring 16. As mentioned, the arms 12 may be directly mounted to (i.e., fixed), or optionally, removably mounted to the outer ring 18. A ratchet assembly 22 may also be provided to allow a user to grasp the handhold 20 to impart a force to the outer ring 18 sufficient to cause the outer ring 18—and thus the arms 14—to revolve around the inner ring 16 of the grip 12. More specifically, the ratchet assembly 22 may be configured so that the outer ring 18 may "slip" relative to the inner ring 16 and thereby remain substantially stationary as the inner ring 16 is rotated in a first direction. Then, as the inner ring 16 is rotated in a second opposite direction the ratchet assembly 22 may engage and drive the outer ring 18 so that the outer ring 18 may revolve around the inner ring 16. The apparatus 10 may be formed or otherwise constructed, in whole or in combination, from a plastic, a metal, or other materials well known in the art.

Figure 4:
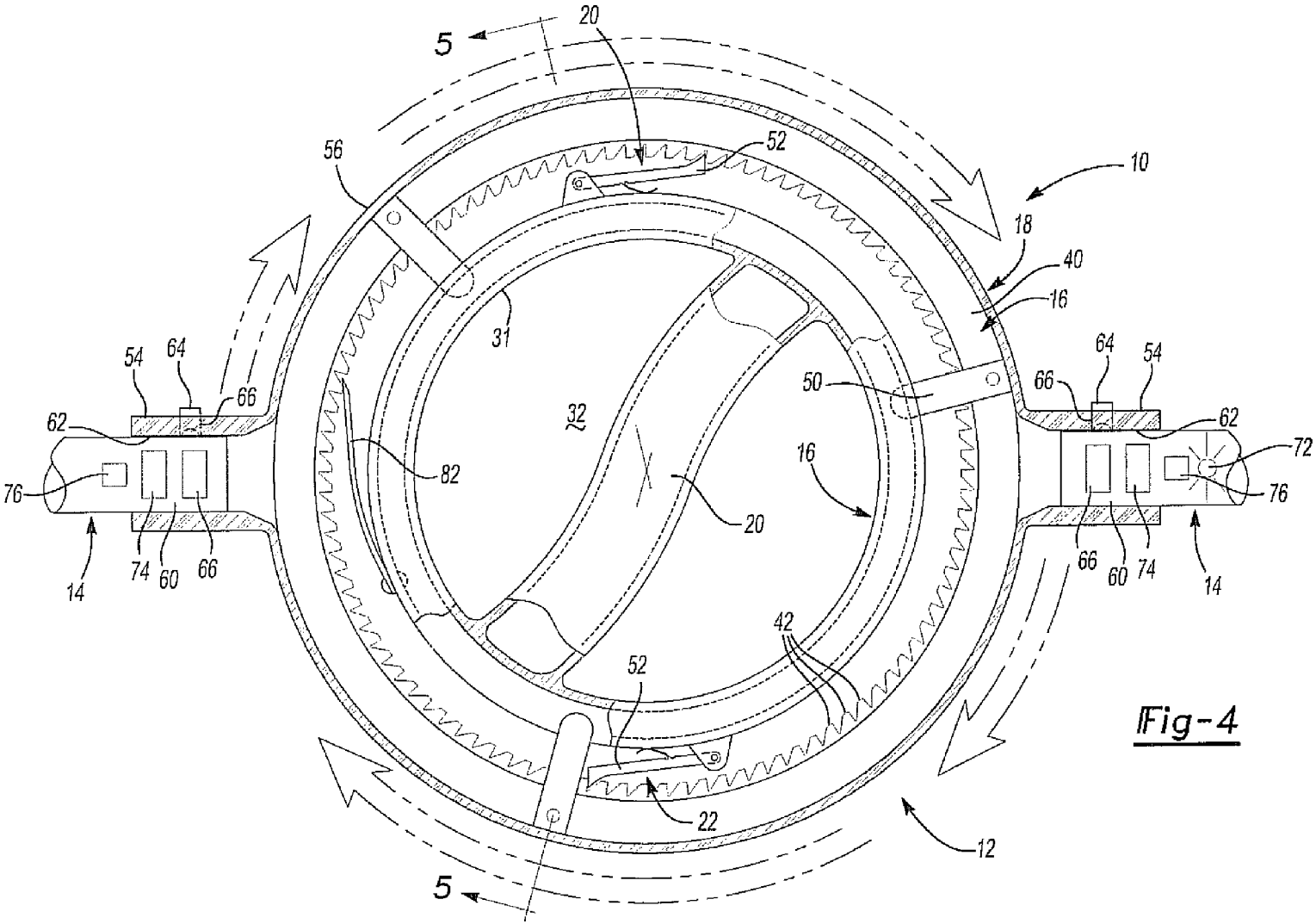
FIG. 4 is a cut-away side view of the grip of the baton apparatus shown in FIG. 1 taken along line 3-3 of FIG. 3.
Figure 5:
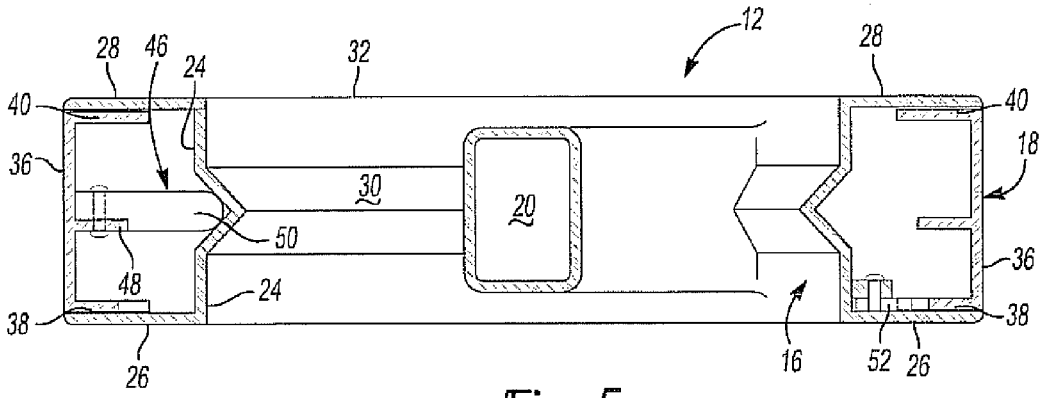
FIG. 5 is a cut-away side view of the grip of the baton apparatus shown in FIG. 1 taken perpendicular to line 3-3.
Figure 6:
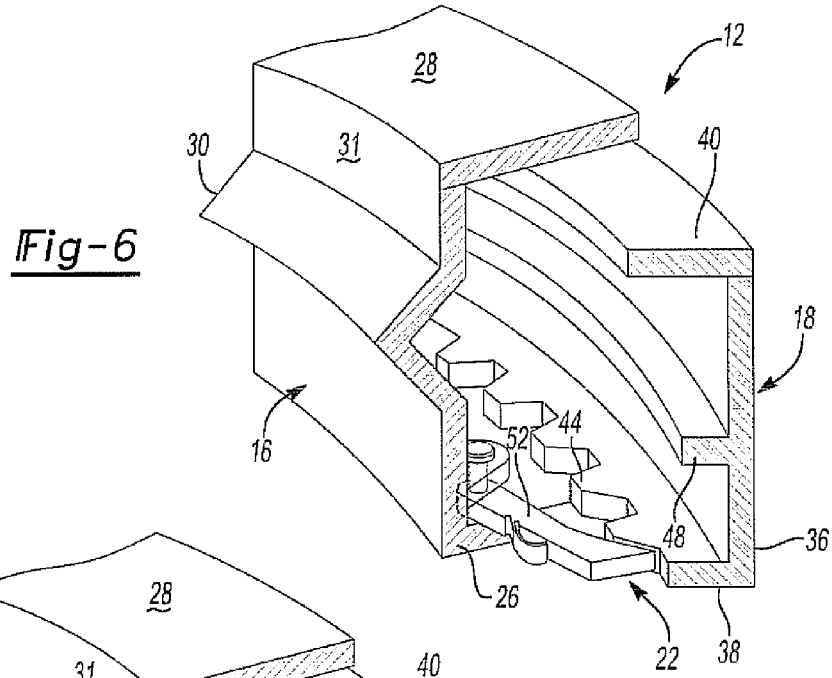
FIG. 6 is a cut-away partial view of the grip of the baton apparatus shown in FIG. 1 showing the ratchet assembly.
Figure 7:
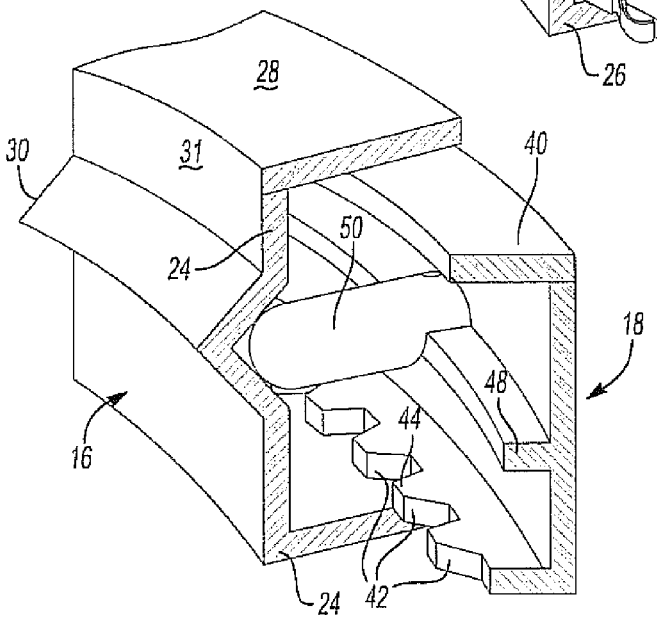
FIG. 7 is a cut-away partial view of the grip of the baton apparatus shown in FIG. 1 showing the support of the outer ring engaging the groove of the inner ring.

Still referring to FIGS. 1-7, and as best shown in FIGS. 5-7, the inner ring 16 of the grip 12 may include a floor 24 and a pair of opposed sidewalls 26, 28 that extend from each end of the floor 24. The walls 26, 28 and floor 24 may thus together define a channel having an open top. At least one of the sidewalls 26 may be removably secured to the floor 24 so that, as will be described infra, the outer ring 18 may be introduced into the channel. A groove 30 may be configured along a centerline of the floor 24. And, as will also be described infra, this groove 30 may operate as a track for portions of the outer ring 18 to follow as the outer ring 18 revolves around the inner ring 16. In addition, an exterior face 31 of the floor 24 may define an open interior space 32 for the inner ring 16 and the handhold 20 may include a handle that extends substantially across the space 32 between opposing portions of the face 31.

Still referring to FIGS. 1-7, and as best shown in FIGS. 5-7, the outer ring 18 may be dimensioned and configured to engage and revolve around the inner ring 16. More specifically, the outer ring 18 may be configured so that it may be received in, and rotate within, the channel of the inner ring 16. The outer ring 18, for example, may include a base 36 and a pair of opposed walls 38, 40 that extend from each end of the base 36. At least one of the walls 38, may have teeth 42 defined along an edge 44. A support 46 may also extend from the base 36 between the walls 38, 40 and have a length that is sufficient to engage the groove 34. In one embodiment, the support 46 may include a flange 48 that extends from the base 36 and between the walls 38, 40 and also a nylon guide 50 that is mounted to and extends from the flange 48. Alternatively, the support 46 may include an elongated tab (e.g., a elongated version of the flange 48) that extends around a centerline of the outer ring 18. As a still further alternative, the groove 30 may be dispensed with and the support 46 may include a wheel (not shown) mounted to a flange that may operate to engage and ride along the floor 24.

Still referring to FIGS. 1-7, and as best shown in FIGS. 4 and 6, the ratchet assembly 22 may include the toothed edge 42, 44 of the wall 38 of the outer ring 18 and one or more pawl(s) 52. The pawl(s) 52 may be positioned on the floor 24 of the inner ring 16 proximate a wall 26 and biased by springs (not shown) into engagement with the teeth 44 of the wall 38. However, it will be appreciated that other locations for the pawl 52 could be used, and other arrangements for the ratchet assembly 22 may also be considered.

Referring now to FIGS. 1-4, a number of holders or receptacles 54, each one operating to receive an arm 14, may be positioned uniformly on an exterior surface 56 of the base 36 of the outer ring 18. Accordingly, where two arms 14 are used, the receptacles 54 may be positioned coaxially (e.g., 180 degrees apart) along the outer ring 18. Where three arms 14 are used, the receptacles 54 may be spaced along the outer ring 18 at intervals of 120 degrees. Where four arms 14 are used, the interval may be 90 degrees. Five arms would result in receptacles positioned at intervals of 72 degrees, etc.

Still referring to FIGS. 1-4, each arm 14 may be constructed as an elongated tube. One end 60 of each arm 14 may include a clip 62 having a flexible detent 64 assembly that may engage an aperture 66 in a receptacle 54 so that the arm 14 may be removably secured in the receptacle 54. An opposite end 68 of each arm 14 may include a weight 70. This weight 70 may be spherical in shape and constructed from, for example, rubber or metal. In addition, each arm 14 may be constructed as a solid color or generally transparent article. Each arm 14 may also include one or more lights. For example, an arm 14 having a generally transparent body may include plurality of LEDs 72 along its interior. The activation of these LEDs 72 may be triggered by a motion sensor 66 positioned on the arm 14 or grip 12. Power for the LEDs 72 may be supplied by batteries 74 disposed within the arm 14 or grip 12 and the LEDs 72 may be controlled by an circuit board 76 that is likewise positioned in the arm 14 or grip 12. Indicia or other graphics 78 may also be added to an exterior surface of each arm 14.

Referring now to FIG. 4, a predetermined length of flexible plastic material 82 may be attached to, and extend tangentially away from, the floor 24 of the inner ring 16. This material 82 may function as a clapper by striking the teeth 42 of the outer ring 18 as it rotates with respect to the inner ring 16.

Referring now to FIGS. 1-7, in operation, following the temporary removal of the sidewall 26 of the inner ring 16, the outer ring 18 may be positioned within the channel of inner ring 16. When configured in this way, the base 36 of the outer ring 18 may function to close the top of the channel, the walls 38, 40 of the outer ring 18 may extend into the channel and parallel to the walls 26, 28 of the inner ring 16, and the support 46 may engage the groove 34. The user may then grasp and turn the handhold 20 of the inner ring 16 in a predetermined direction (clockwise or counterclockwise). As the user turns the inner ring 16, the outer ring 18 may "slip" relative to the inner ring 16 and/or otherwise remain relatively stationary with respect to the inner ring 16. Then, following this "wind-up" motion, the user may initiate a rotation of the outer ring 18 by rotating the inner ring 16 in the opposite direction. This rotation of the inner ring 16 in the opposite direction causes the ratchet assembly 22 to engage, drive and rotate the outer ring 18 (and the arms 14 mounted to the outer ring 18).

Having thus described an embodiment of a baton apparatus, various other embodiments will become apparent to those of skill in the art that do not depart from the scope of the claims.

The invention claimed is:

1. A baton apparatus comprising:

a grip including an inner ring and an outer ring, the inner ring having a hand hold, the outer ring being mounted concentric to the inner ring and being movable with respect to the inner ring;

a ratchet assembly positioned on the grip, the ratchet assembly operating to permit the outer ring to remain substantially stationary as the inner ring is rotated in a first direction and to also permit the inner ring to drive the outer ring when the inner ring is rotated in a second opposite direction; and at least two arms mounted to, extending radially outward from, the outer ring.

2. The baton apparatus of claim 1, wherein the inner ring includes a channel having a floor, the floor having a groove defined along a centerline of the floor, and the outer ring includes a support tab, the support tab engaging the groove of the floor to slideably support the outer ring on the inner ring.

3. The baton apparatus of claim 1, wherein the inner ring comprises a floor and a pair of sidewalls that extend perpendicular to the floor, the floor and walls defining a channel, and the outer ring being positioned in the channel.

4. The baton apparatus of claim 3, wherein the floor comprises a groove along a centerline of the floor, and the outer ring operating to slidably engage the groove.

5. The baton apparatus of claim 4, wherein the outer ring comprises a base and a pair of opposed walls that extend perpendicular to the base.

6. The baton apparatus of claim 5, wherein the ratchet assembly comprises a pawl mounted to the inner ring and a plurality of teeth that are engaged by the pawl and that are defined in an edge of at least one of the walls of the outer ring that is opposite the base.

7. The baton apparatus of claim 3, wherein one sidewall of the inner ring is removably secured to the floor of the inner ring.

8. The baton apparatus of claim 3, wherein the floor comprises an exterior face that defines an open space, and the handhold comprises a handle extending substantially across open space between opposing portions of the face.

9. The baton apparatus of claim 1, wherein each arm includes a light.

10. The baton apparatus of claim 1, wherein the outer ring includes at least two arm receptacles, and each of the arms is removably secured in one of the receptacles.

11. A baton apparatus comprising:

a grip including an inner ring and an outer ring, the inner ring having a hand hold, the outer ring being mounted concentric to the inner ring and being movable with respect to the inner ring;

a ratchet assembly positioned on the grip, the ratchet assembly operating to permit the outer ring to remain substantially stationary as the inner ring is rotated in a first direction and to also permit the inner ring to drive the outer ring when the inner ring is rotated in a second opposite direction; and at least two arms removably mounted to, extending radially outward from, the outer ring, each arm including a light.

12. The baton apparatus of claim 11, wherein the arms are mounted coaxial to the outer ring.

13. The baton apparatus of claim 11, further comprising a motion sensor mounted to the grip.

14. The baton apparatus of claim 11, further comprising a motion sensor mounted to an arm.

15. The baton apparatus of claim 11, further comprising a clapper mounted to the grip.

16. The baton apparatus of claim 11, wherein each arm includes a weight at an end of the arm opposite the outer ring.

17. The baton apparatus of claim 11, wherein the ratchet assembly comprises a pawl mounted to the inner ring and a plurality of teeth defined in the outer ring that are engaged by the pawl.

18. A baton apparatus comprising:

a grip including an inner ring and an outer ring, the inner ring having a hand hold, the outer ring being mounted concentric to the inner ring and being movable with respect to the inner ring;

a ratchet assembly positioned on the grip, the ratchet assembly operating to permit the outer ring to remain substantially stationary as the inner ring is rotated in a first direction and to also permit the inner ring to drive the outer ring when the inner ring is rotated in a second opposite direction;

at least two arms removably mounted coaxial to, extending radially outward from, the outer ring, each arm including a light; and a motion sensor mounted in at least one of an arm or the grip.

19. The baton apparatus of claim 18, wherein the ratchet assembly comprises a pawl mounted to the inner ring and a plurality of teeth defined in the outer ring that are engaged by the pawl.

20. The baton apparatus of claim 18, further comprising a clapper mounted to the grip, the clapper emitting an audible sound as the outer ring moves relative to the inner ring.

* * * * *